US007768482B2

(12) United States Patent
Kwak

(10) Patent No.: US 7,768,482 B2
(45) **Date of Patent: *Aug. 3, 2010**

(54) DISPLAY DEVICE AND DRIVING METHOD THEREOF

(75) Inventor: Won-Kyu Kwak, Suwon-si (KR)

(73) Assignee: Samsung Mobile Display Co., Ltd., Yongin-si (KR)

( * ) Notice: Subject to any disclaimer, the term of this patent is extended or adjusted under 35 U.S.C. 154(b) by 807 days.

This patent is subject to a terminal disclaimer.

(21) Appl. No.: 11/055,441

(22) Filed: Feb. 10, 2005

(65) Prior Publication Data

US 2005/0200573 A1 Sep. 15, 2005

(30) Foreign Application Priority Data

Mar. 15, 2004 (KR) ..... 10-2004-0017310

(51) Int. Cl.
*G09G 3/30* (2006.01)

(52) U.S. Cl. ..... 345/76; 345/77; 345/82; 315/169.3

(58) Field of Classification Search ..... 345/76, 345/77, 82; 315/169.3
See application file for complete search history.

(56) References Cited

U.S. PATENT DOCUMENTS 5,748,160 A 5/1998 Shieh et al.
6,184,853 B1 * 2/2001 Hebiguchi et al. ..... 345/88
6,421,033 B1 * 7/2002 Williams et al. ..... 345/55
6,583,775 B1 * 6/2003 Sekiya et al. ..... 345/76
6,618,031 B1 * 9/2003 Bohn et al. ..... 345/83
2002/0043941 A1 4/2002 Iketsu et al.
2003/0214493 A1 11/2003 Akimoto et al.
2005/0017934 A1 1/2005 Chung et al.
2005/0110723 A1 5/2005 Shin (Continued)

FOREIGN PATENT DOCUMENTS

CN 1577453 A 2/2005

(Continued)

OTHER PUBLICATIONS

European Search Report, dated Jun. 16, 2005, for application No. 05100524.7, in the name of Samsung SDI Co., Ltd.

(Continued)

*Primary Examiner*—Alexander Eisen
*Assistant Examiner*—Stuart McCommas
(74) *Attorney, Agent, or Firm*—Christie, Parker & Hale, LLP

(57) ABSTRACT

Red, green, and blue organic electroluminescent (EL) elements formed on a pixel in an organic EL display are driven by a driving transistor. A capacitor is coupled between a gate and a source of the driving transistor to maintain a voltage for a predetermined time. Emission control transistors are coupled between the driving transistor and the red, green, and blue organic EL elements, respectively. One field is divided into three subfields, and one of the red, green, and blue organic EL elements in each pixel starts to emit light in each subfield to thus represent a full color screen. The red, green, and blue are mixed and emitted in the row direction and column direction in each of the subfields of a field.

26 Claims, 10 Drawing Sheets

U.S. PATENT DOCUMENTS

| | | | |
|---|---|---|---|
| 2006/0097966 | A1 | 5/2006 | Choi |
| 2006/0103611 | A1 | 5/2006 | Choi |
| 2007/0138947 | A1 | 6/2007 | Popovic et al. |

FOREIGN PATENT DOCUMENTS

| | | | |
|---|---|---|---|
| CN | 1622723 | A | 6/2005 |
| EP | 0 762 374 | A1 | 3/1997 |
| EP | 1 531 452 | A1 | 5/2005 |
| JP | 02-073292 | | 3/1990 |
| JP | 06-124069 | | 5/1994 |
| JP | 09-138659 | | 5/1997 |
| JP | 10-333639 | | 12/1998 |
| JP | 2002-072980 | | 3/2002 |
| JP | 2002-149129 | | 5/2002 |
| JP | 2002-297083 | | 10/2002 |
| JP | 2003-510661 | | 3/2003 |
| JP | 2003-122306 | | 4/2003 |
| JP | 2005-148749 | | 6/2005 |
| JP | 2005-148750 | | 6/2005 |
| JP | 2005-148751 | | 6/2005 |
| JP | 2005-157258 | | 6/2005 |
| JP | 2005-157267 | | 6/2005 |
| WO | WO 01/24153 | A1 | 4/2001 |

OTHER PUBLICATIONS

EPO Patent Abstracts of Japan for Publication No. 10333639, publication date Dec. 18, 1998, in the name of J. Hashiguchi.

EPO Patent Abstracts of Japan for Publication No. 2002149129, publication date May 24, 2002, in the name of A. Yamanaka.

Patent Abstracts of Japan for Publication No. 09-138659; dated May 27, 1997 in the name of Chan-Long Shieh et al.

Patent Abstracts of Japan for Publication No. 2002-297083; dated Oct. 9, 2002 in the name of Hideto Kitakado et al.

Patent Abstracts of Japan for Publication No. 2002-072980; dated Mar. 12, 2002 in the name of Masao Imai.

Patent Abstracts of Japan for Publication No. 2003-122306; dated Apr. 25, 2003 in the name of Akira Yumoto.

Office Action dated May 9, 2008 for related Chinese Patent Application No. 200610143369.3 indicating relevance of the cited references.

Japanese Office action dated Mar. 24, 2009, for corresponding Japanese application 2006-038395, noting listed references in this IDS, and JP 2003-122306 in the Feb. 20, 2008 IDS (5 pgs.).

U.S. Office action dated Jul. 6, 2009, for related U.S. Appl. No. 11/519,730, noting listed references in this IDS.

* cited by examiner

DISPLAY DEVICE AND DRIVING METHOD THEREOF

CROSS REFERENCE TO RELATED APPLICATION

This application claims priority to and the benefit of Korea Patent Application No. 10-2004-0017310 filed on Mar. 15, 2004 in the Korean Intellectual Property Office, the entire content of which is incorporated herein by reference.

BACKGROUND OF THE INVENTION (a) Field of the Invention

The present invention relates to a display device and a driving method thereof. More specifically, the present invention relates to an organic electroluminescent (EL) display using electroluminescence of organic matter, and a driving method thereof.

(b) Description of the Related Art

In general, an organic EL display is a display device for electrically exciting phosphorous organic compounds and emitting light. The organic EL display drives organic light emission cells arranged in a matrix format to represent images. An organic light emission cell having a diode characteristic is referred to as an organic light emission diode (OLED) and has a structure including an anode electrode layer, an organic thin film, and a cathode electrode layer. Holes and electrons injected through the anode electrode and the cathode electrode are combined on the organic thin film, and emit light. The organic light emission cell emits different amounts of light according to injected amounts of electrons and holes, that is, depending on the applied current.

In the organic EL display, a pixel includes a plurality of sub-pixels each of which has one of a plurality colors (e.g., primary colors of light), and colors are represented through combinations of the colors emitted by the sub-pixels. In general, a pixel includes a sub-pixel for displaying red R, a sub-pixel for displaying green G, and a sub-pixel for displaying blue B, and the colors are displayed by combinations of red, green, and blue (RGB).

Each sub-pixel in the organic EL display includes a driving transistor for driving an organic EL element, a switching transistor, and a capacitor. Also, each sub-pixel has a data line for transmitting a data signal, and a power line for transmitting a power supply voltage VDD. Therefore, many wires are required for transmitting voltages or signals to the transistors and capacitor formed at each pixel. It is difficult to arrange such wires in the pixel, and the aperture ratio corresponding to a light emission area of the pixel is reduced.

SUMMARY OF THE INVENTION

In an exemplary embodiment of the present invention, is provided a display device in which the aperture ratio is improved.

In another exemplary embodiment of the present invention, is provided a display device for simplifying configurations and wiring of elements in the pixel.

In another exemplary embodiment of the present invention, a plurality of light emission elements in a pixel share a driver.

In one aspect of the present invention, a display includes a plurality of pixels arranged in rows and columns, a plurality of select lines coupled to the pixels for applying a plurality of select signals, and a plurality of data lines for applying data signals to the pixels. The pixels display an image during a field having a plurality of subfields. Each of the pixels includes a plurality of light emitting elements having different colors. Each of the select signals is coupled to a corresponding one of the rows of pixels to apply a corresponding one of the select signals thereto. The select signals sequentially select the rows of pixels during each of the plurality of subfields. The pixels on the same one of the rows start emitting different color lights in each of the plurality of subfields. In one of the subfields, at least one of the pixels starts emitting light having a color which is different from a color of a light it starts emitting in another one of the subfields.

In another aspect of the present invention, a display device includes a plurality of scan lines including a first scan line and a second scan line for applying select signals, a plurality of data lines including a first data line and a second data line for applying data signals for displaying an image during a field having a plurality of subfields, and a plurality of pixel circuits coupled to the scan lines and the data lines. Each of the pixel circuits includes: at least two emit elements, a capacitor, and a driving transistor. The emit elements emit light having different colors, wherein each of the emit elements emits light responsive to an applied current. The capacitor stores a voltage corresponding to one of the data signals applied in response to one of the select signals. The driving transistor outputs the applied current corresponding to the voltage stored in the capacitor. In a first one of the subfields, one of the emit elements of a first color starts emitting light in a first pixel circuit of the pixel circuits, which is coupled to the first scan line and the first data line, one of the emit elements of a color which is different from the first color starts emitting light in a second pixel circuit of the pixel circuits, which is coupled to the first scan line and the second data line, one of the emit elements of a second color starts emitting light in a third pixel circuit of the pixel circuits, which is coupled to the second scan line and the first data line, and one of the emit elements of a color which is different from the second color starts emitting light in a fourth pixel circuit of the pixel circuits, which is coupled to the second scan line and the second data line.

The emit elements may include an emit element of the first color, an emit element of the second color, and an emit element of a third color. At least one of the pixel circuits may further include a first emitting transistor, a second emitting transistor, and a third emitting transistor. The first emitting transistor may be coupled between the driving transistor and the emit element of the first color, the second emitting transistor may be coupled between the driving transistor and the emit element of the second color, and the third emitting transistor may be coupled between the driving transistor and the emit element of the third color.

In a second one of the subfields, the emit element of the second color may start emitting light in the first pixel circuit, and one of the emit elements of a color which is different from the second color may start emitting light in the second pixel circuit. In a third one of the subfields, the emit element of the third color may start emitting light in the first pixel circuit, and one of the emit elements of a color which is different from the third color may start emitting light in the second pixel circuit.

The emit element of the third color may start emitting light in the third pixel circuit in the second one of the subfields, and the emit element of the first color may start emitting light in the third pixel circuit in the third one of the subfields.

One of the emit elements of a color which is different from colors of the emit elements which start emitting light in the first and second pixel circuits may start emitting light in a fifth pixel circuit of the pixel circuits, which is coupled to the first scan line and the third data line in the first, second and third ones of the subfields.

One of the emit elements of a color which is different from colors of the emit elements which start emitting light in the first and third pixel circuits may start emitting light in a sixth pixel circuit of the pixel circuits, which is coupled to the third scan line and the first data line in the first, second and third ones of the subfields.

The emit element of the first color, the emit element of the second color and the emit element of the third color may emit light at least once during the field.

In another aspect of the present invention, a display device includes a plurality of scan lines, a plurality of data lines, and a plurality of pixel circuits. The scan lines apply select signals, the data lines apply data signals for displaying an image during a field having a plurality of subfields. The pixel circuits are coupled to the scan lines and data lines. Each of the pixel circuits includes at least two emit elements, a switching transistor, a capacitor, a driving transistor, and a switch. The emit elements emit light having different colors, wherein each of the emit elements emits light responsive to an applied current. The switching transistor applies one of the data signals corresponding to one of the emit elements in response to one of the select signals at least once during the field. The capacitor stores a voltage corresponding to one of the data signals applied by the switching transistor. The driving transistor outputs the applied current corresponding to the voltage stored in the capacitor, and the switch selectively outputs the applied current provided by the driving transistor to one of the emit elements of a color which corresponds to the one of the data signals. In a first one of the subfields, one of the data signals corresponding to one of the emit elements of a first color is applied to a data line of a first group including at least one of the data lines, and one of the data signals corresponding to one of the emit elements of a second color is applied to a data line of a second group including at least one of the data lines, when one of the select signals is applied to a scan line of a first group including at least one of the scan lines.

In still another aspect of the present invention, in a display device including a plurality of pixel circuits arranged in rows and columns, a method of driving during a field having a plurality of subfields is provided. Each of the pixel circuits includes at least two emit elements for emitting light of different colors responsive to an applied current, and a transistor coupled to the emit elements supplies the applied current to one of the emit elements through at least one switch. The method includes, start emitting, in a first one of the subfields, one of the emit elements of a first color in a first pixel circuit provided on a row of a first row group including at least one of the rows and a column of a first column group including at least one of the columns; start emitting, in the first one of the subfields, one of the emit elements of a second color which is different from the first color in a second pixel circuit provided on a row of the first row group and a column of a second column group including at least one of the columns; and start emitting, in a second one of the subfields, the emit elements of colors in the first and second pixel circuits, respectively, which are different from the first and second colors, respectively.

BRIEF DESCRIPTION OF THE DRAWINGS

The accompanying drawings illustrate exemplary embodiments of the present invention, and, together with the description, serve to explain the principles of the invention.

DETAILED DESCRIPTION

Figure 1:
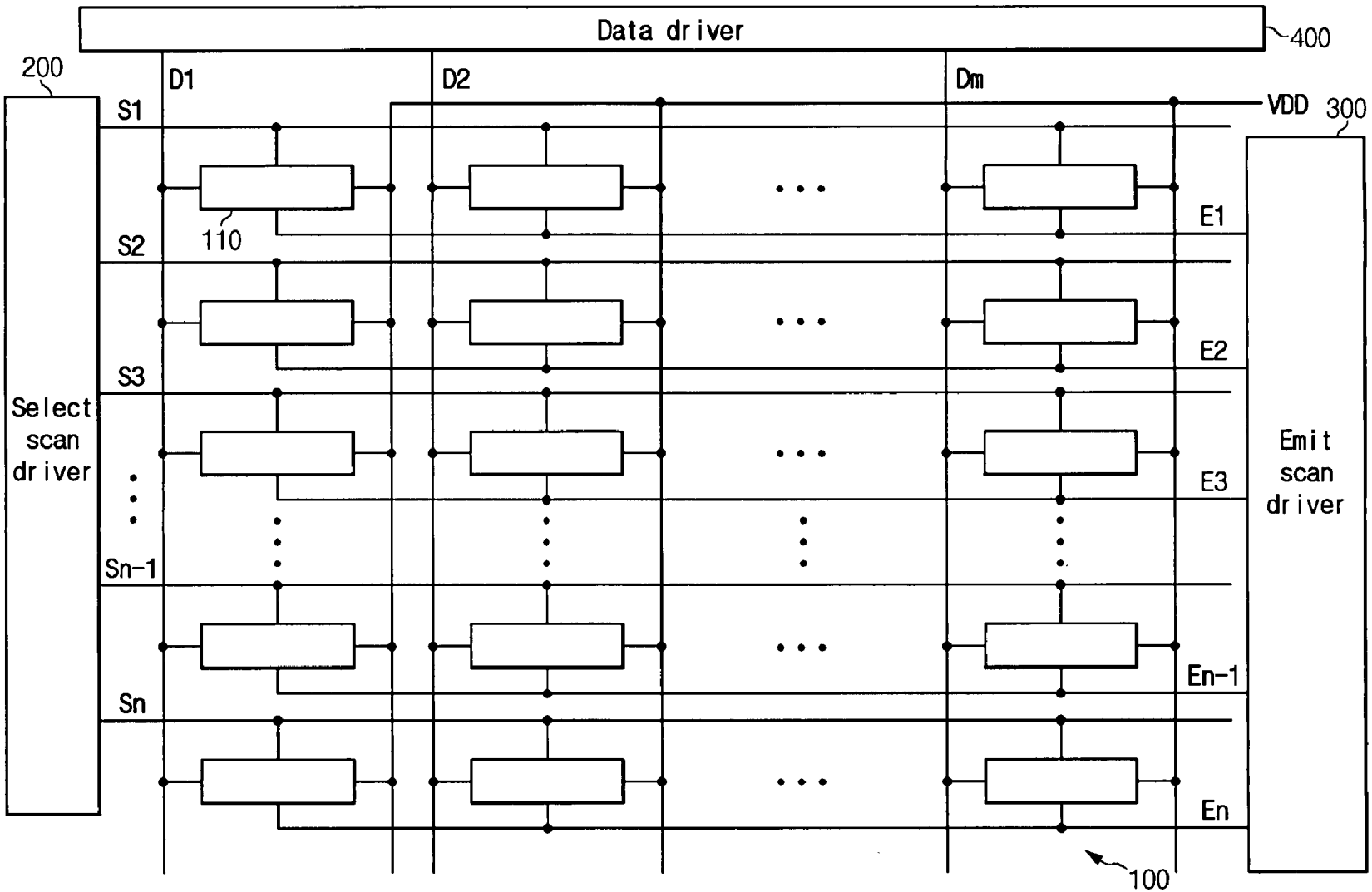
FIG. 1 shows a plan view of an organic EL display used to implement exemplary embodiments of the present invention.

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive. There may be parts shown in the drawings, or parts not shown in the drawings, that are not discussed in the specification as they are not essential to a complete understanding of the invention. Like reference numerals designate like elements.

A light emission display and driving method according to exemplary embodiments of the present invention will be described in detail with reference to drawings, and an organic EL display will be exemplified and described in the exemplary embodiments.

Figure 2:
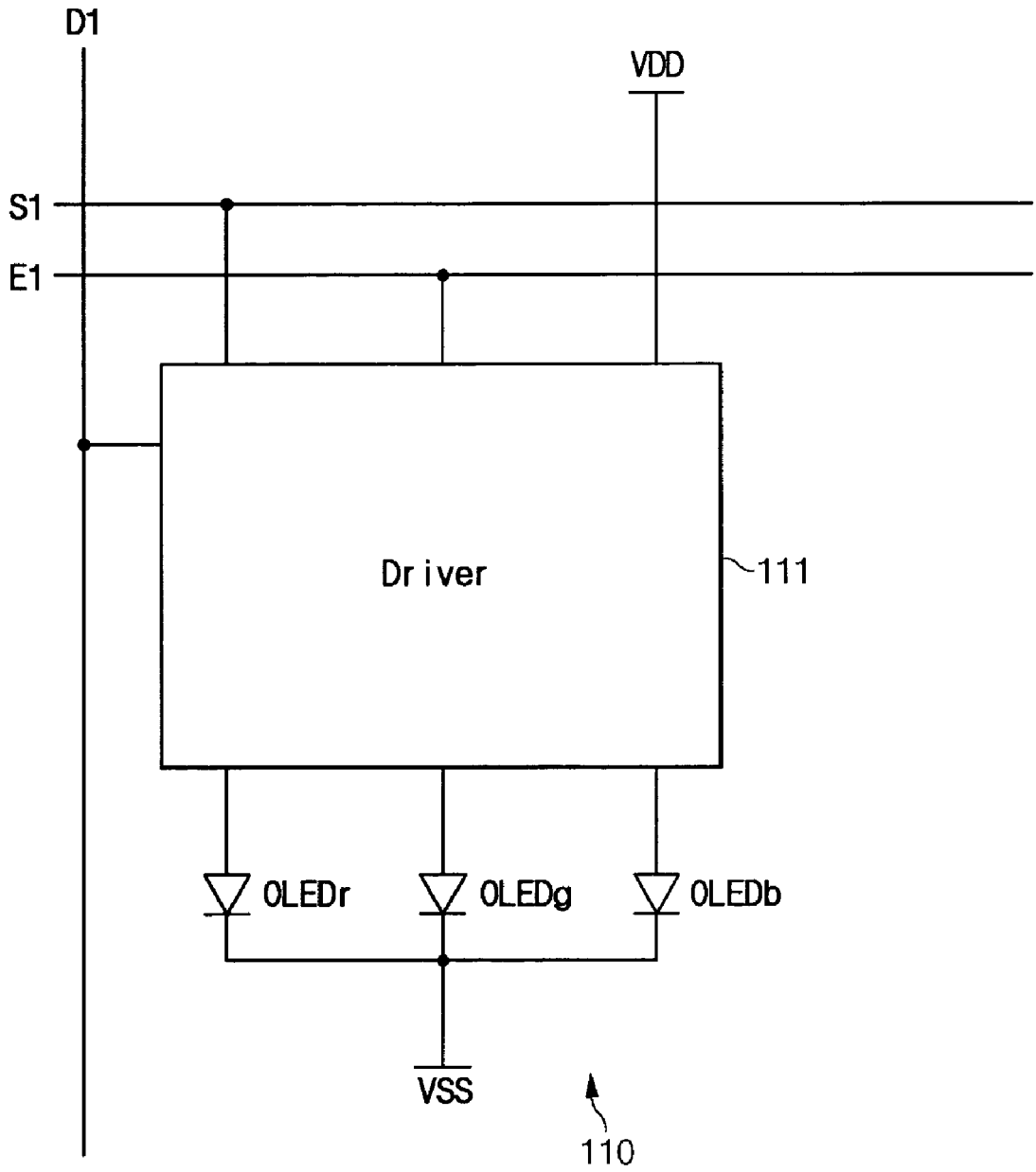
FIG. 2 shows a conceptual diagram of a pixel in the organic EL display of FIG. 1.

FIG. 1 shows a plan view of an organic EL display used to implement exemplary embodiments of the present invention, and FIG. 2 shows a conceptual diagram of a pixel in the organic EL display of FIG. 1.

As shown in FIG. 1, the organic EL display includes a display 100, a select scan driver 200, an emit scan driver 300, and a data driver 400. The display 100 includes a plurality of scan lines S1 to Sn and E1 to En arranged in the row direction, and a plurality of data lines D1 to Dm, a plurality of power lines VDD, and a plurality of pixels 110 respectively arranged in the column direction. The pixels are formed at pixel areas formed by two adjacent ones of the scan lines S1 to Sn and two adjacent ones of the data lines D1 to Dm. Referring to FIG. 2, the pixel 110 includes organic EL elements OLEDr, OLEDg, and OLEDb for emitting red, green, and blue lights, respectively, and a driver 111 on which elements for driving the organic EL elements OLEDr, OLEDg, and OLEDb are formed. The organic EL elements emit light having brightness corresponding to the applied current.

The select scan driver 200 sequentially transmits select signals for selecting corresponding lines to the select scan lines S1 to Sn in order to apply data signals to pixels of the corresponding lines, the emit scan driver 300 sequentially transmits emit signals for controlling light emission of the organic EL elements OLEDr, OLEDg, and OLEDb to the emit scan lines E1 to En, and the data driver 400 applies data signals corresponding to the pixels of lines to which select signals are applied to the data lines D1 to Dm each time the select signals are sequentially applied.

The select and emit scan drivers 200 and 300 and the data driver 400 are coupled to a substrate on which the display 100 is formed. In addition, the select and emit scan drivers 200 and 300 and/or the data driver 400 can be installed directly on the substrate of the display 100, and they can be substituted with a driving circuit which is formed on the same layer on the substrate of the display 100 as the layer on which scan lines, data lines, and transistors are formed. Further, the select and emit scan drivers 200 and 300 and/or the data driver 400 can be installed in a chip format on a tape carrier package (TCP), a flexible printed circuit (FPC), or a tape automatic bonding unit (TAB) coupled to the select and emit scan drivers 200 and 300 and/or the data driver 400.

One field is divided into three subfields and then driven, and red, green, and blue data are written on the three subfields to emit light in the first exemplary embodiment. For this purpose, the select scan driver 200 sequentially transmits select signals to the select scan lines S1 to Sn for each subfield, the emit scan driver 300 applies emit signals to the emit scan lines E1 to En so that the organic EL element for each color may emit light in a subfield, and the data driver 400 applies data signals respectively corresponding to the red, green, and blue organic EL elements to the data lines D1 to Dm.

A detailed operation of the organic EL display according to a first exemplary embodiment will be described with reference to FIGS. 3 and 4.

Figure 3:
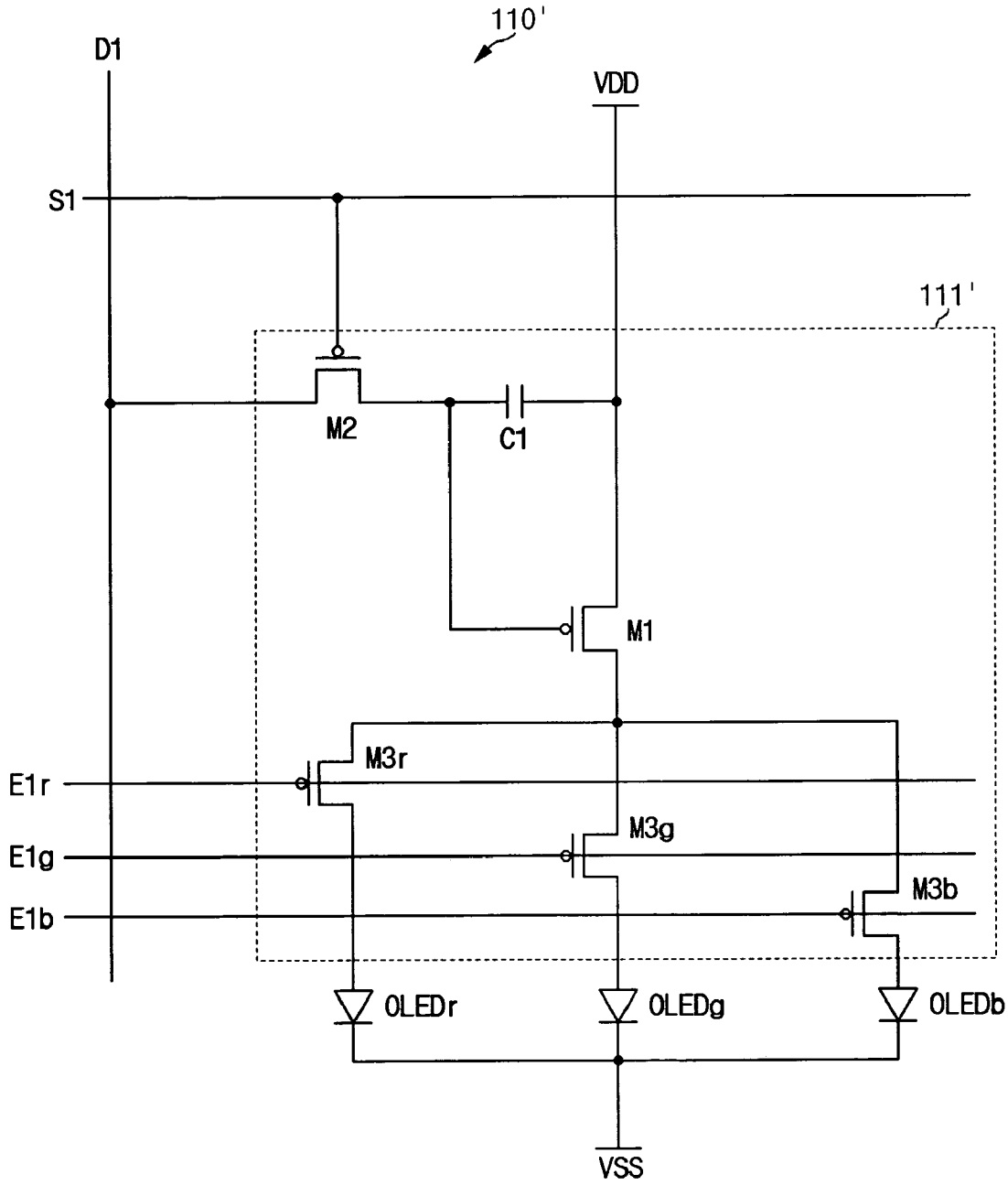
FIG. 3 shows a circuit diagram of a pixel in an organic EL display according to a first exemplary embodiment of the present invention.
Figure 4:
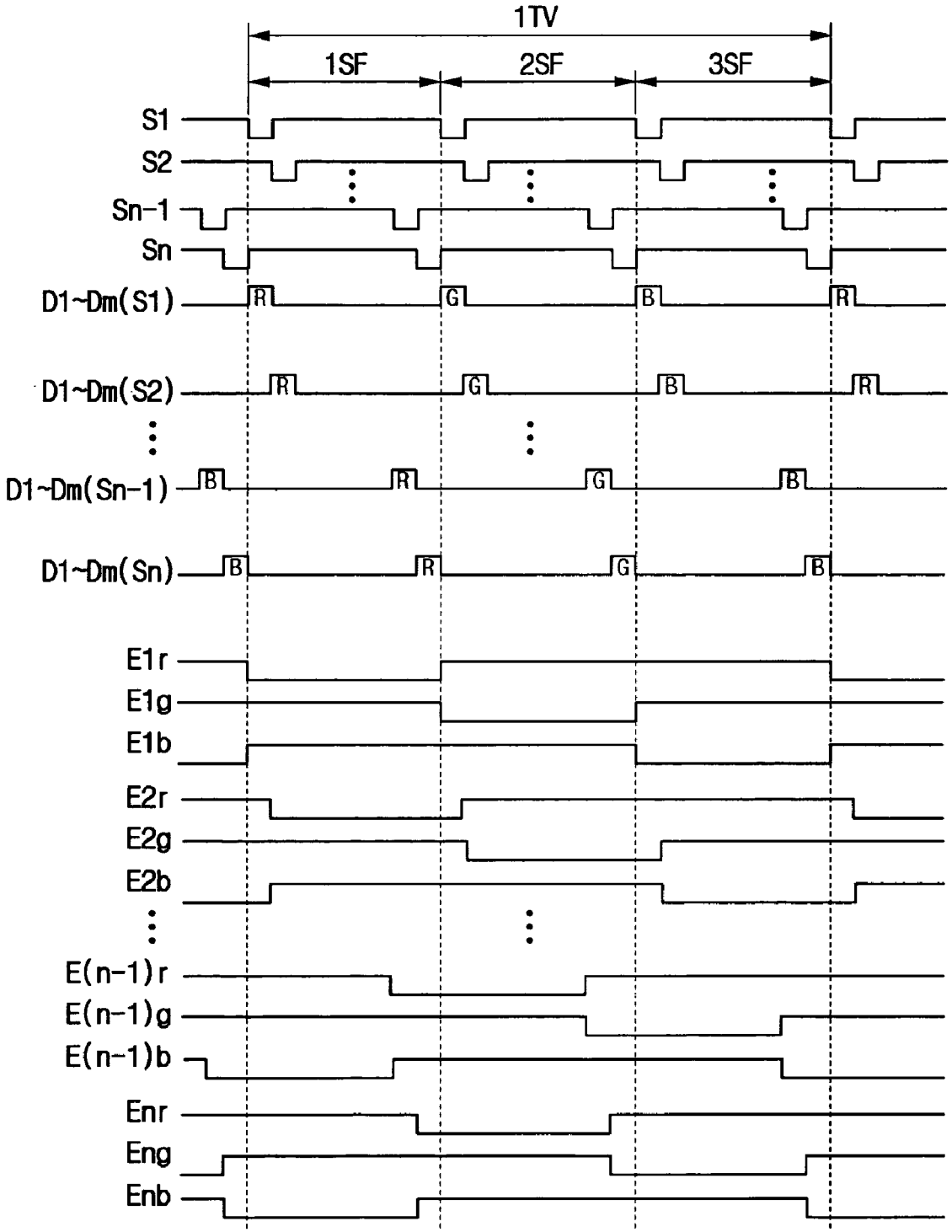
FIG. 4 shows a signal timing diagram of an organic EL display according to the first exemplary embodiment of the present invention.

FIG. 3 shows a circuit diagram of a pixel 110' in the organic EL display according to the first exemplary embodiment of the present invention, and FIG. 4 shows a signal timing diagram of the organic EL display according to the first exemplary embodiment of the present invention. The pixel 110', for example, can be used as the pixel 110 of FIGS. 1 and 2. In detail, FIG. 3 shows a voltage programmed pixel coupled to the select scan line S1 of the first row and the data line D1 of the first column. The pixel 110' includes p-channel transistors. No other pixels will be described in reference to the first exemplary embodiment since the pixels of first exemplary embodiment have substantially the same structure as that shown in FIG. 3.

As shown in FIG. 3, the pixel circuit 110' according to the first exemplary embodiment includes a driver 111' and organic EL elements OLEDr, OLEDg, and OLEDb. The driver 111' includes a driving transistor M1, a switching transistor M2, and emitting transistors M3*r*, M3*g*, and M3*b* for controlling light emission of the organic EL elements OLEDr, OLEDg, and OLEDb. One emit scan line E1 includes three emit signal lines E1*r*, E1*g*, and E1*b*, and while not illustrated in FIG. 3, other emit scan lines E2 to En respectively include three emit signal lines E2*r* to Enr, E2*g* to Eng, and E2*b* to Enb. The emitting transistors M3*r*, M3*b*, and M3*b* and the emit signal lines E1*r*, E1*g*, and E1*b* form a switch for selectively transmitting the current provided by the driving transistor M1 to the organic EL elements OLEDr, OLEDg, and OLEDb.

In detail, the switching transistor M2 having a gate coupled to the select scan line S1 and a source coupled to the data line D1 transmits the data voltage provided by the data line D1 in response to the select signal provided by the select scan line S1. The driving transistor has a source coupled to the power line VDD for supplying a power supply voltage, and has a gate coupled to a drain of the switching transistor M2, and a capacitor C1 is coupled between a source and a gate of the driving transistor M1. The driving transistor M1 has a drain coupled to sources of the emit transistors M3*r*, M3*g*, and M3*b*, and gates of the emit transistors M3*r*, M3*g*, and M3*b* are coupled to the emit signal lines E1*r*, E1*g*, and E1*b*, respectively. Drains of the emit transistors M3*r*, M3*g*, and M3*b* are coupled, respectively, to anodes of the organic EL elements OLEDr, OLEDg, and OLEDb, and a power supply voltage VSS is applied to cathodes of the organic EL elements OLEDr, OLEDg, and OLEDb. The power supply voltage VSS in the first exemplary embodiment can be a negative voltage or a ground voltage.

The switching transistor M2 transmits the data voltage provided by the data line D1 to the gate of the driving transistor M1 in response to a low-level select signal provided by the select scan line S1, and the voltage which corresponds to a difference between the data voltage transmitted to the gate of the transistor M1 and the power supply voltage VDD is stored in the capacitor C1. When the emitting transistor M3*r* is turned on in response to a low-level emit signal provided by the emit signal line E1*r*, the current which corresponds to the voltage stored in the capacitor C1 is transmitted to the red organic EL element OLEDr from the driving transistor M1 to emit light. In a like manner, when the emitting transistor M3*g* is turned on in response to a low-level emit signal provided by the emit signal line E1*g*, the current which corresponds to the voltage stored in the capacitor C1 is transmitted to the green organic EL element OLEDg from the driving transistor M1 to emit light. Further, when the emitting transistor M3*b* is turned on in response to a low-level emit signal provided by the emit signal line E1*b*, the current which corresponds to the voltage stored in the capacitor C1 is transmitted to the blue organic EL element OLEDb from the driving transistor M1 to emit light. Three emit signals applied to the three emit signal lines respectively have low-level periods without repetition during one field so that one pixel can display red, green, and blue.

An organic EL display driving method will be described in detail with reference to FIG. 4. Referring to FIG. 4, one field 1TV includes three subfields 1SF, 2SF, and 3SF, and signals for driving the red, green, and blue organic EL elements are applied to the subfields 1SF, 2SF, and 3SF, periods of which are the same.

In the subfield 1SF, when a low-level select signal is applied to the select scan line S1 on the first row, data voltages of R corresponding to red of the pixels on the first row are applied, respectively, to the data lines D1 to Dm, and a low-level emit signal is applied to the emit signal line E1*r* on the first row. The corresponding one of the data voltages of R is applied to the capacitor C1 through the switching transistor M2 of each pixel on the first row, and a voltage corresponding to the corresponding one of the data voltages of R is charged in the capacitor C1. The emitting transistor M3*r* of the pixel on the first row is turned on, and a current corresponding to a gate-source voltage stored in the capacitor C1 is transmitted to the red organic EL element OLEDr from the driving transistor M1 to thus emit light.

Next, when a low-level select signal is applied to the select scan line S2 on the second row, the data voltages of R corresponding to the red of pixels of the second row are applied, respectively, to the data lines D1 to Dm, a low-level emit signal is applied to the emit signal line E2*r* of the second row, and a current corresponding to the corresponding one of the data voltages of R provided by a corresponding one of the data lines D1 to Dm is supplied to the red organic EL element OLEDg of each pixel on the second row to thus emit light.

Then the data voltages are sequentially applied to pixels of from the third to (n−1)th rows to emit the red organic EL element OLEDr. When a low-level select signal is applied to the select scan line Sn on the nth row, the data voltages of R corresponding to the red of the pixels of the nth row are applied to the data lines D1 to Dm, and a low-level emit signal is applied to the emit signal line Enr of the nth row. A current corresponding to a corresponding one of the data voltages of R provided by the data lines D1 to Dm is accordingly supplied to the red organic EL element OLEDr of each pixel on the nth row to thus emit light.

As a result, the data voltages of R corresponding to red are applied to the respective pixels formed on the display panel 100 during the subfield 1SF. The emit signals applied to the emit signal lines E1*r* to Enr are maintained at the low level for a predetermined time, and the organic EL element OLEDr coupled to the emitting transistor M3*r* to which the corresponding emit signal is applied during the emit signal is at the low level consecutively emits light. This period is illustrated to correspond to the subfield 1SF in FIG. 4. That is, the red organic EL element OLEDr for each pixel emits light with brightness which corresponds to the data voltage applied during the period which corresponds to the subfield.

In the subfield 2SF, in a like manner as the subfield 1SF, a low-level select signal is sequentially applied to the select scan lines S1 to Sn of from the first to the nth rows, and when the select signal is applied to the respective select scan lines S1 to Sn, data voltages of G corresponding to green of pixels of the corresponding rows are applied, respectively, to the data lines D1 to Dm. A low-level emit signal is sequentially applied to the emit signal line E1*g* to Eng in synchronization with sequentially applying the low-level select signal to the select scan lines S1 to Sn. A current corresponding to the applied data voltage is transmitted to the green organic EL element OLEDg through the emitting transistor M3*g* in each pixel to emit light.

In the subfield 3SF, in a like manner as the subfield 2SF, a low-level select signal is sequentially applied to the select scan lines S1 to Sn of from the first to the nth rows, and when the select signal is applied to the respective select scan lines S1 to Sn, data voltages of B corresponding to blue of pixels of the corresponding rows are applied, respectively, to the data lines D1 to Dm. A low-level emit signal is sequentially applied to the emit signal lines E1*b* to Enb in synchronization with sequentially applying the low-level select signal to the select scan lines S1 to Sn. A current corresponding to the applied data voltage of B is transmitted to the blue organic EL element OLEDb through the emitting transistor M3*b* in each pixel to emit light.

As described above, one field is divided into three subfields, and the subfields are sequentially driven in the organic EL display driving method according to the first exemplary embodiment. One color organic EL element of one pixel in each subfield emits light, and the organic EL elements of three colors (red, green, and blue) sequentially emit light through three subfields to thus represent colors.

The signal timing diagram of FIG. 4 illustrates that the organic EL display is driven from the single scan method to the progressive scan method. In addition, the organic EL display can be driven using a dual scan method, an interlaced scan method, and other scan methods without being restricted to them.

Also, the red, green, and blue organic EL elements have been described to emit light during the same period according to the first exemplary embodiment, but the white balance can be incorrect because of different efficiency of the organic EL elements of respective colors when they emit light during the same period. In this case, the emit periods of the organic EL elements of respective colors are to be modified, which will be described with reference to FIG. 5.

Figure 5:
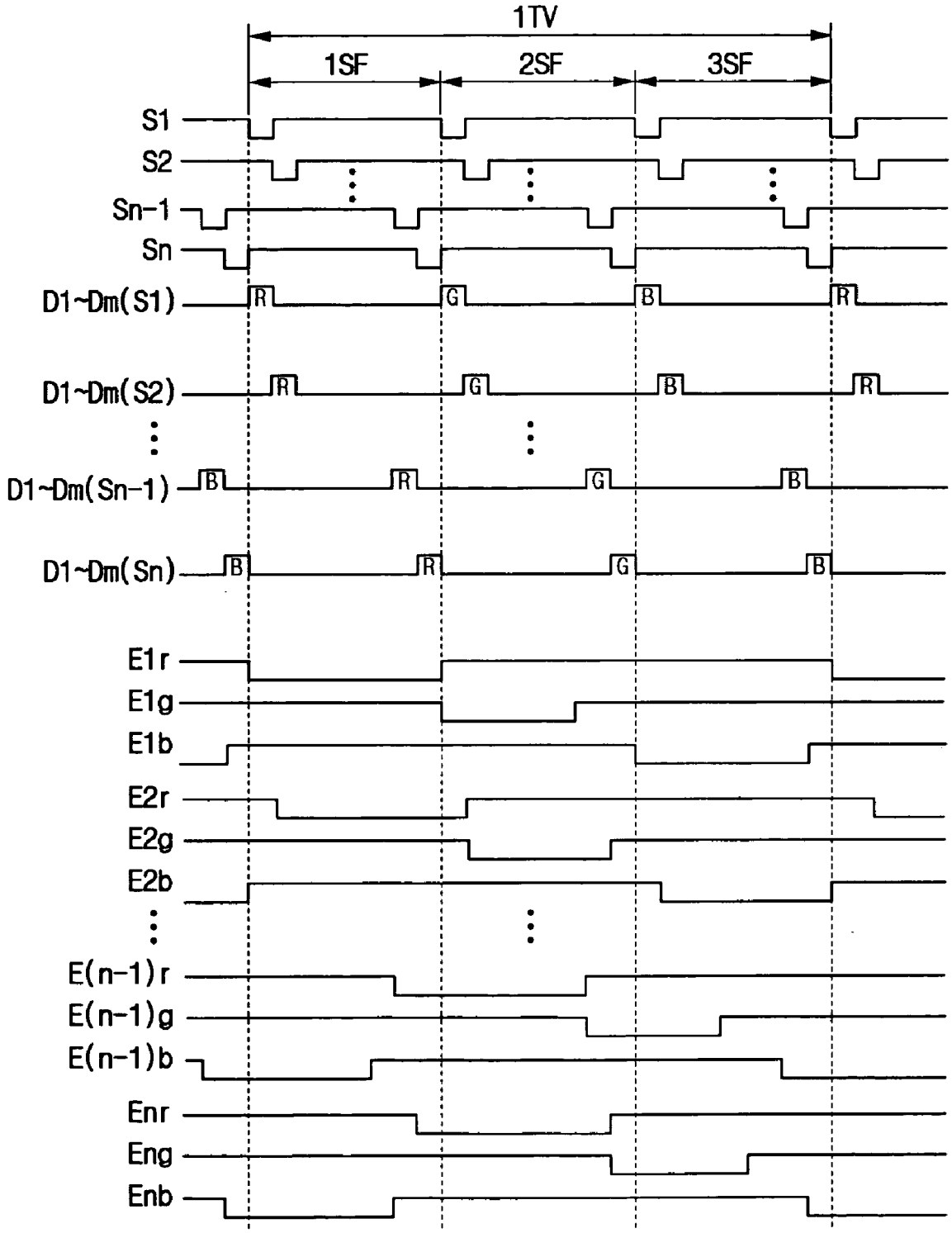
FIGS. 5 and 6 show signal timing diagrams of an organic EL display according to second and third exemplary embodiments of the present invention.

FIG. 5 shows a signal timing diagram of the organic EL display according to a second exemplary embodiment of the present invention.

As shown in FIG. 5 differing from FIG. 4, low-level periods of emit signals applied to the emit signal lines E1*r* to Enr corresponding to red, emit signals applied to the emit signal lines E1*g* to Eng corresponding to green, and emit signals applied to the emit signal lines E1*b* to Enb corresponding to blue are different from each other. As described above, the emit periods of the organic EL elements depend on low-level periods of the emit signals applied to the gates of the emitting transistors M3*r*, M3*g*, and M3*b* coupled to the corresponding organic EL elements, and hence, emit times of the respective organic EL elements can be varied by providing different low-level periods of emit signals.

For example in FIG. 5, low-level periods of emit signals applied to the emit signal lines E1*r* to Enr coupled to the gate of the transistor M3*r* coupled to the red organic EL element OLEDr are established to be the longest, and low-level periods of emit signals applied to the emit signal lines E1*b* to Enb coupled to the gate of the transistor M3*b* coupled to the blue organic EL element OLEDb are established to be the shortest. An emit time of the red organic EL element OLEDr is lengthened, and an emit time of the blue organic EL element OLEDb is shortened. The white balance is controlled well through the above-noted process when the emit efficiency of the red organic EL element OLEDr is the worst and the emit efficiency of the blue organic EL element OLEDb is the best.

The colors are controlled to emit light in the order of red, green, and blue in FIGS. 4 and 5, and they can emit light in other orders. Also, it is possible to divide a field into four subfields rather than three subfields and control the fourth subfield to drive an organic EL element of one color to emit light, or drive organic EL elements of two or more colors concurrently. Further, it is possible to add an organic EL element for displaying white in addition to the three organic EL elements, and either drive the white organic EL element during a subfield or drive four-color organic EL elements respectively during four subfields.

Figure 6:
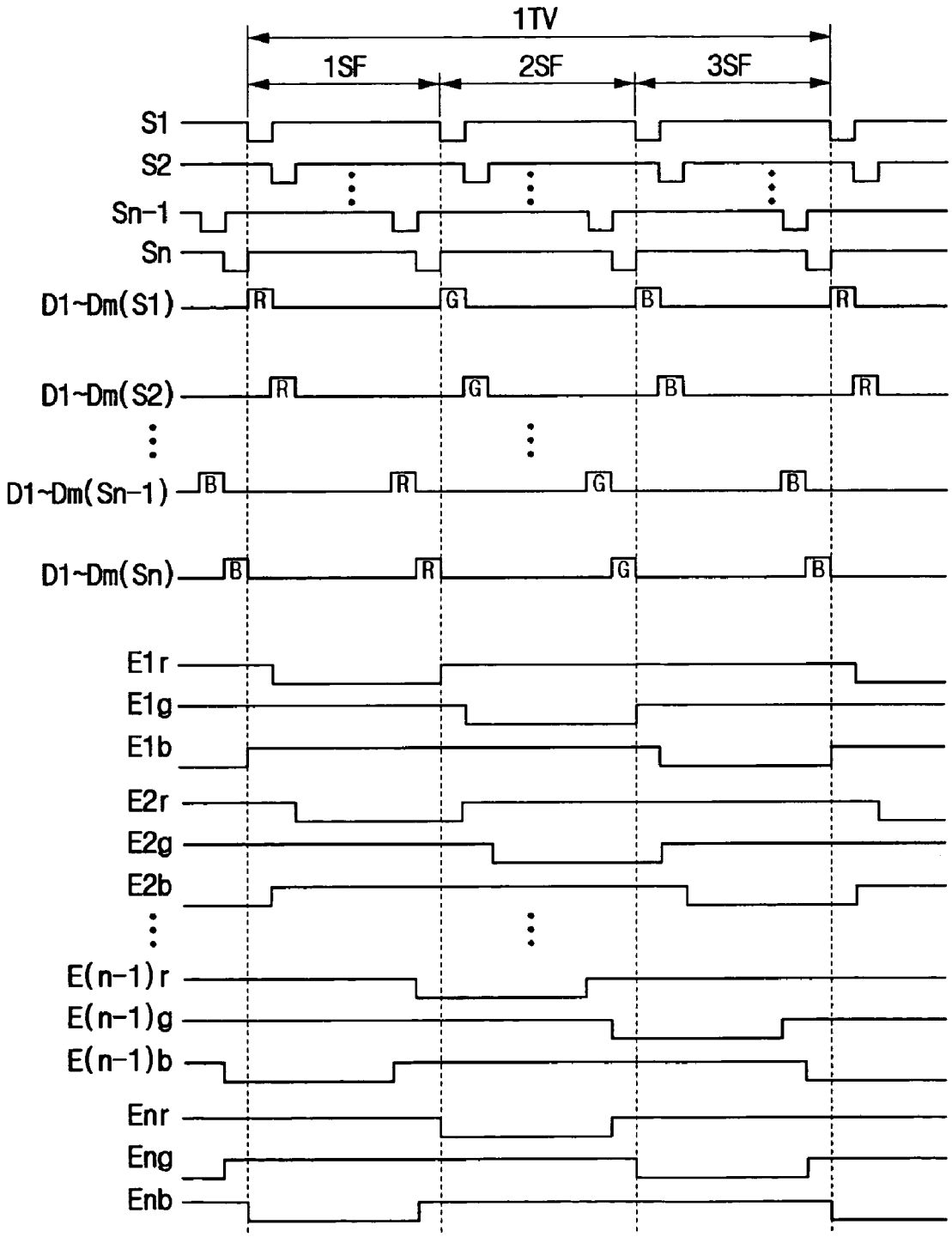

Also, referring to FIGS. 4 and 5, the select signal has been illustrated to be low-level and the emit signal has been illustrated to be concurrently low-level in one pixel. Alternatively, the emit signal can be low-level after the select signal is switched to high-level from low-level. That is, referring to FIG. 6, the select signal becomes high-level and the emit signal applied to the emit signal lines E1*r*, E1*g*, and E1*b* becomes low-level after the select signal applied to the select scan line S1 changes from low-level to high-level and a voltage which corresponds to the data voltage provided by the data lines D1 to Dm is programmed to the capacitor C1 of each pixel according to the third exemplary embodiment. As a result, the organic EL elements are prevented from emitting light while the data are programmed.

P-channel transistors have been applied to the pixels according to the first to third exemplary embodiments, and n-channel transistors, combinations of p-channel and n-channel transistors, and other switches having similar functions as the p-channel and n-channel transistors can also be used in addition to the p-channel transistors.

The emitting transistors M3*r*, M3*g*, and M3*b* have been driven by individual emit signal lines in the first to third exemplary embodiments. That is, three emit signal lines have been used for each pixel. Differing from this, all three of the pixels can be driven using only two emit signal lines, which will now be described with reference to FIGS. 7 and 8.

Figure 7:
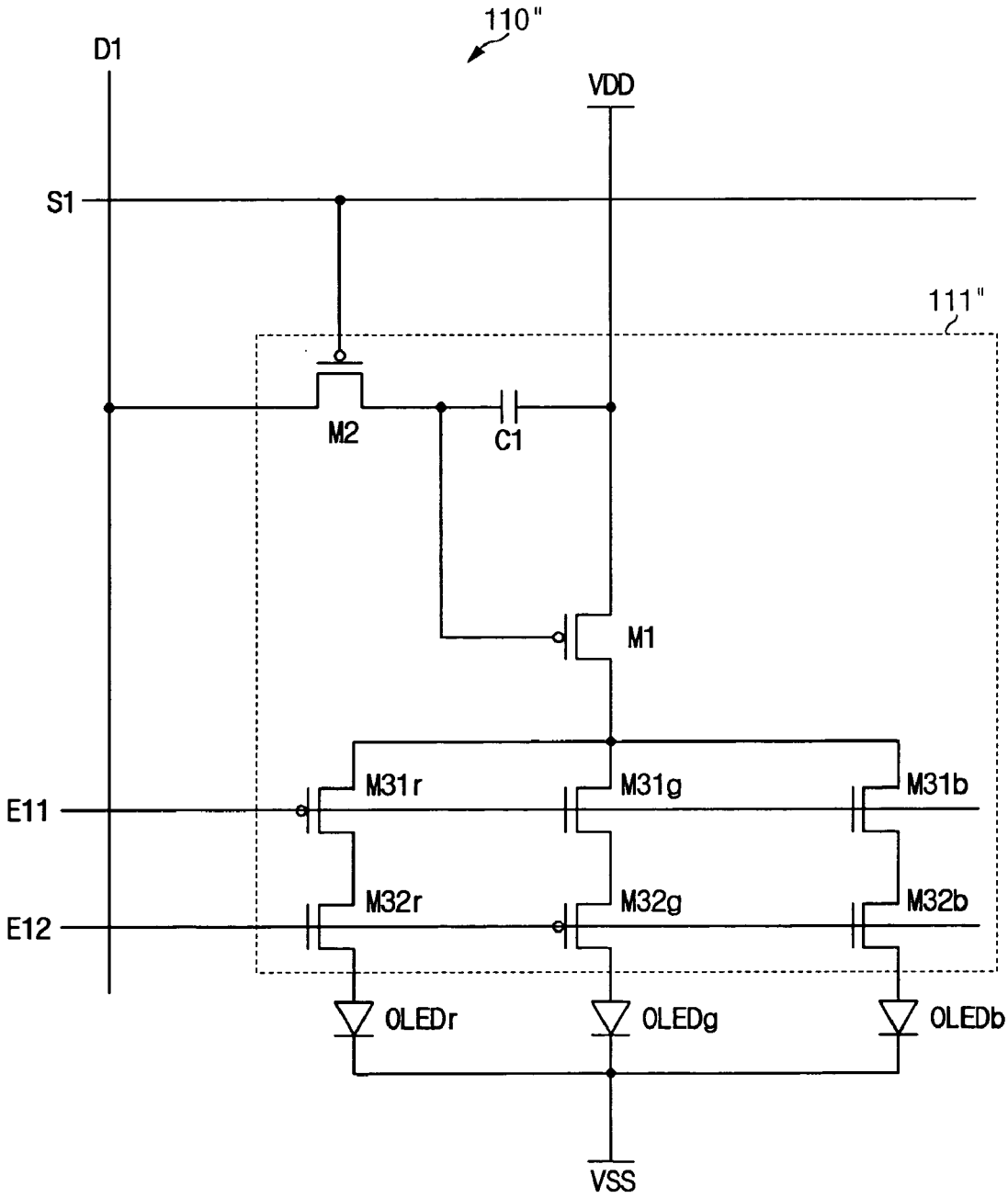
FIG. 7 shows a circuit diagram of a pixel in an organic EL display according to a fourth exemplary embodiment of the present invention.
Figure 8:
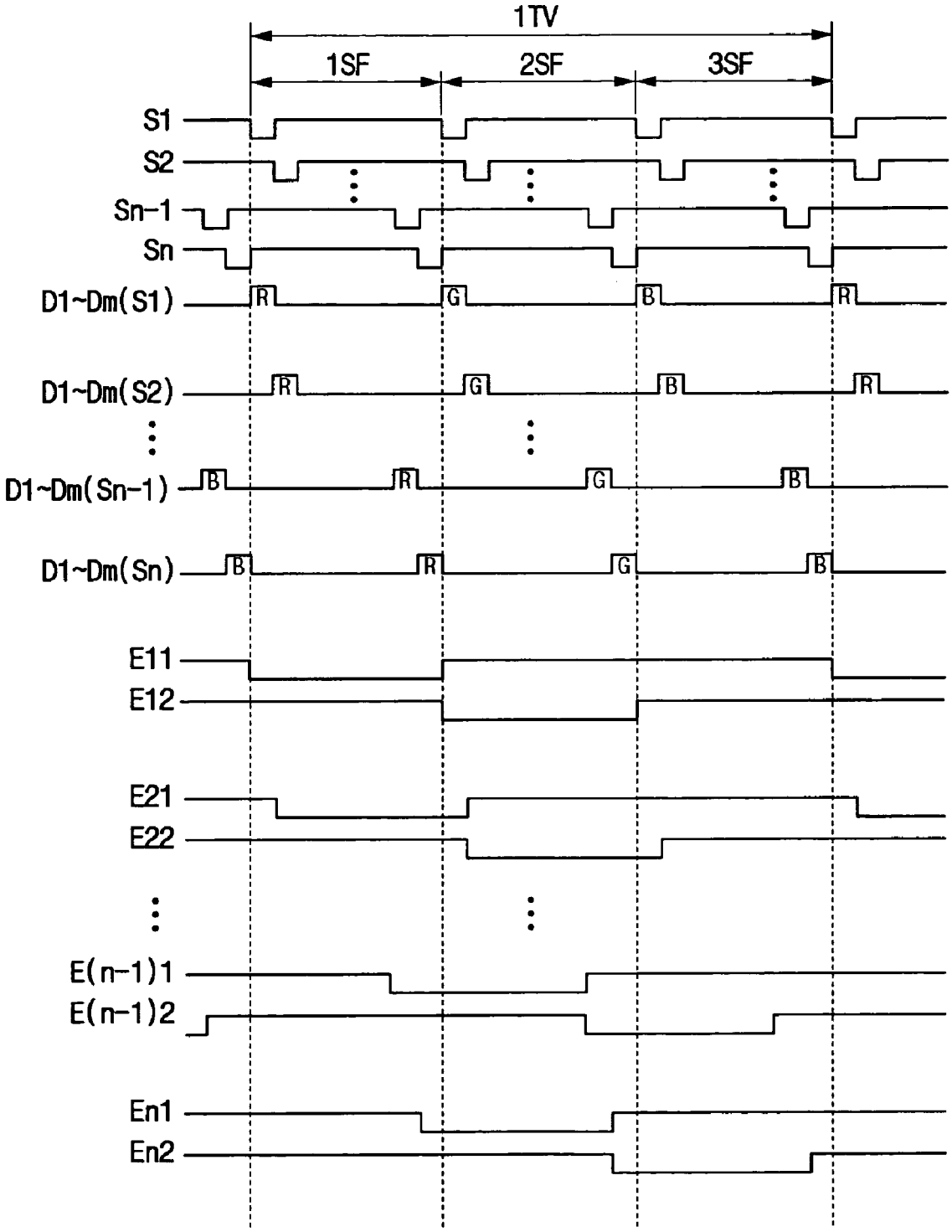
FIG. 8 shows a signal timing diagram of the organic EL display according to the fourth exemplary embodiment of the present invention.

FIG. 7 shows a circuit diagram of a pixel 110" in the organic EL display according to a fourth exemplary embodiment of the present invention, and FIG. 8 shows a signal timing diagram of the organic EL display according to the fourth exemplary embodiment of the present invention. In detail, FIG. 7 illustrates a voltage programming pixel 110" coupled to the select scan line S1 of the first row and the data line D1 of the first column. The pixel 110", for example, can be used as the pixel 110 of FIGS. 1 and 2.

Referring to FIG. 7, differing from the pixel circuit of FIG. 3, the pixel circuit according to the fourth exemplary embodiment has two emitting transistors for each color's organic EL element, and the emitting transistors are driven by two emit signal lines. An emit scan line E1 includes two emit signal lines E11 and E12, and other emit scan lines E2 to En have two emit signal lines E21 to En1 and E22 to En2, respectively.

In detail, a p-channel emitting transistor M31*r* and an n-channel emitting transistor M32*r* are coupled in series between a drain of the driving transistor M1 and a red organic EL element OLEDr, an n-channel emitting transistor M31*g* and a p-channel emitting transistor M32*g* are coupled in series between the drain of the driving transistor M1 and a green organic EL element OLEDg, and n-channel emitting transistors M31*b* and M32*b* are coupled in series between the drain of the driving transistor M1 and a blue organic EL element OLEDb. Gates of the emitting transistors M31*r*, M31*g*, and M31*b* are coupled in common to the emit signal line E11, and gates of the emitting transistors M32*r*, M32*g*, and M32*b* are coupled in common to the emit signal line E12.

Accordingly, the current is supplied to the red organic EL element OLEDr when an emit signal applied to the emit signal line E11 is low-level and an emit signal applied to the emit signal line E12 is high-level, the current is supplied to the green organic EL element OLEDg when an emit signal applied to the emit signal line E11 is high-level and an emit signal applied to the emit signal line E12 is low-level, and the current is supplied to the blue organic EL element OLEDb when both the emit signals applied to the emit signal lines E11 and E12 are high-level. That is, when the emit signals are supplied in the three subfields according to the above-described method, the red, green, and blue organic EL elements are sequentially driven with two emit signals according to the signal timing of FIG. 8.

An organic EL display driving method according to the fourth exemplary embodiment of the present invention will be described with reference to FIG. 8. One field (1TV) includes three subfields 1SF, 2SF, and 3SF, and signals for driving red, green, and blue organic EL elements of each pixel are applied to the subfields 1SF, 2SF, and 3SF in a like manner as FIG. 4.

Referring to FIG. 8, emit signals applied to the emit signal lines E11 to En1 have the same timing as that applied to the emit signal lines E1*r* to En*r* of FIG. 4, and emit signals applied to the emit signal lines E12 to En2 have the same timing as that applied to the emit signal lines E1*g* to Eng of FIG. 4.

In the subfield 1SF, since the emit signal applied to the emit signal line E11 is low-level and the emit signal applied to the emit signal line E12 is high-level, the emitting transistors M31*r* and M32*r* are turned on, and hence, the current is supplied to the red organic EL element OLEDr to emit light. However, no current is supplied to the green and blue organic EL elements OLEDg and OLEDb since the n-channel transistors M31*g* and M3*b* coupled to the emit signal line E11 are turned off.

In the subfield 2SF, since the emit signal applied to the emit signal line E11 is high-level and the emit signal applied to the emit signal line E12 is low-level, the emitting transistors M31*g* and M32*g* are turned on, and hence, the current is supplied to the green organic EL element OLEDg to emit light. However, no current is supplied to the red and blue organic EL elements OLEDr and OLEDb since the n-channel transistors M32*r* and M32*b* coupled to the emit signal line E12 are turned off.

In the subfield 3SF, since the emit signals applied to the emit signal lines E11 and E12 are high-level, the emitting transistors M31*b* and M32*b* are turned on, and hence, the current is supplied to the blue organic EL element OLEDb to emit light. However, no current is supplied to the red and green organic EL elements OLEDr and OLEDg since the p-channel transistors M31*r* and M32*g* respectively coupled to the emit signal lines E11 and E12 are turned off.

Therefore, the three-colored organic EL elements are controlled by using two emit signal lines in the fourth exemplary embodiment. The transistors M31*r* and M32*g* are p-channel transistors and the transistors M32*r*, M31*g*, M31*b*, and M32*b* are n-channel transistors in FIGS. 7 and 8. In other embodiments, conductivity types of these transistors can be combined in different manners when the transistors are controllable in a manner similar to that illustrated by the timing diagram of FIG. 8. Also, the timing diagrams similar to those of second and third exemplary embodiments in FIGS. 5 and 6 can be used with the pixel circuit 110" of FIG. 7 according to the fourth exemplary embodiment.

The voltage programming pixel circuit using switching transistors and driving transistors has been described in the first to fourth exemplary embodiments, and a voltage programming pixel circuit using transistors for compensating for threshold voltages of the driving transistors or transistors for compensating for voltage dropping as well as the switching transistors and driving transistors is applicable. Also, the present invention is applicable to current programming pixel circuits when the driving waveform described with reference to FIG. 5, that is, the driving waveform in which the emit signal is high-level while the select signal is low-level.

The organic EL elements sequentially emit light of one color in one subfield, and other organic EL elements sequentially emit light of other colors in the next subfield in the first to fourth exemplary embodiments. The color emitted at upper rows of the display panel is different from the color emitted at lower rows thereof at an instance during the above-noted driving. Referring to FIG. 4, the red organic EL elements emit light in the upper region of the display area and the blue organic EL elements emit light in the lower region of the display area in the temporally middle part of one subfield 1SF. When the organic EL display is shaken in this instance, red areas and blue areas may look separated, which is generally referred to as a color separation phenomenon.

An exemplary embodiment for eliminating or reducing the color separation phenomenon will now be described with reference to FIGS. 9 and 10.

Figure 9:
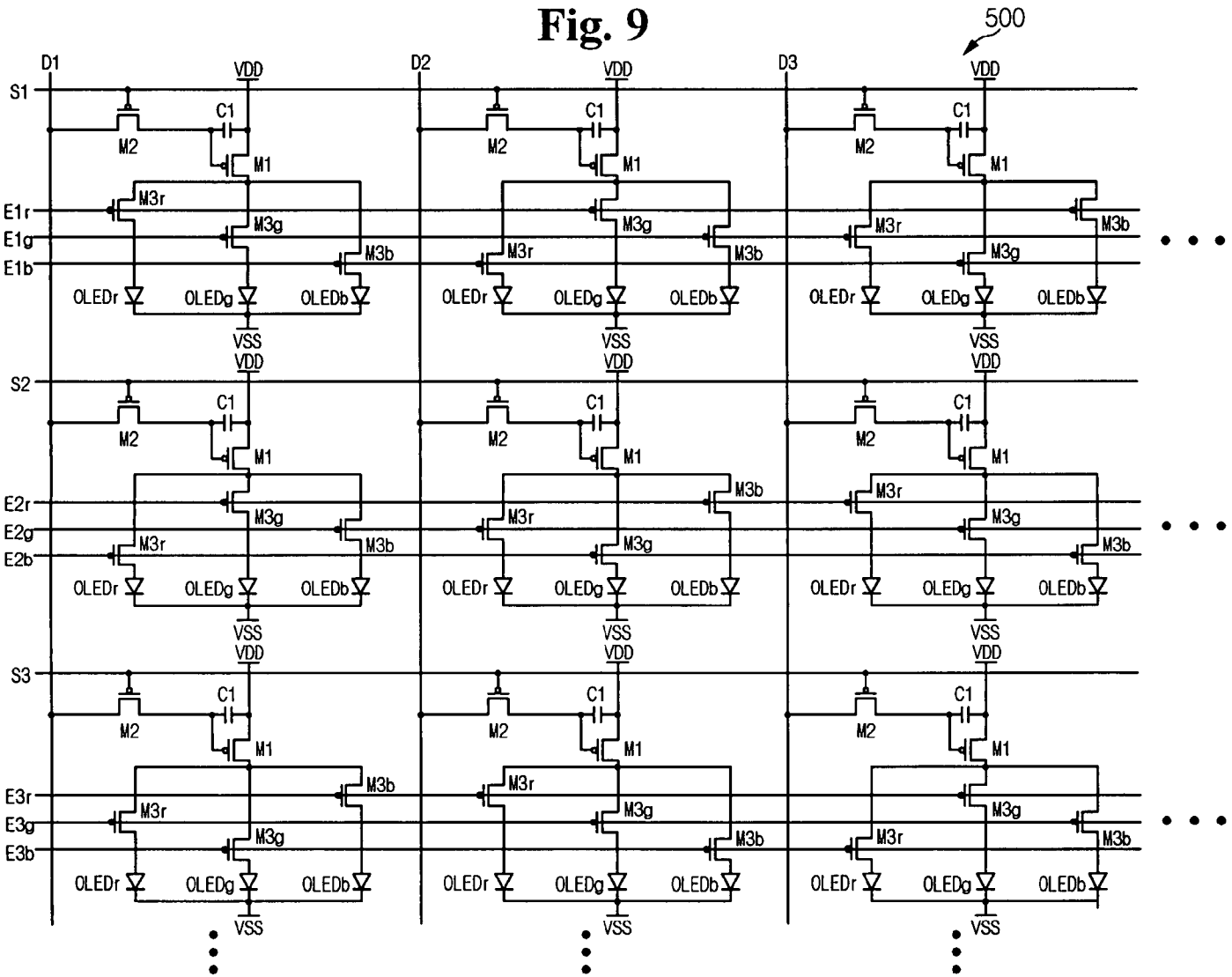
FIG. 9 shows a circuit diagram of a number of pixels in an organic EL display according to a fifth exemplary embodiment of the present invention.
Figure 10:
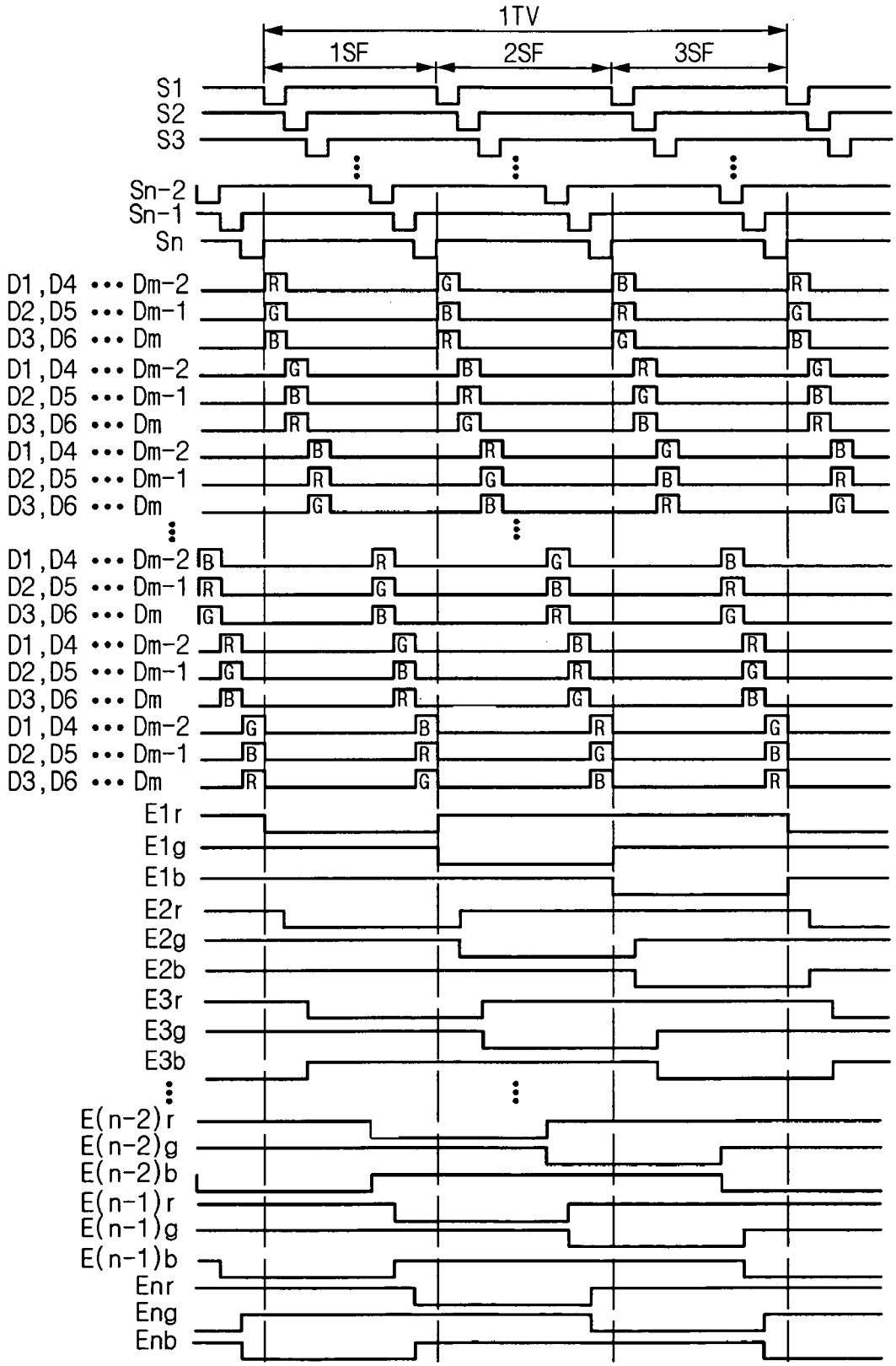
FIG. 10 shows a signal timing diagram of the organic EL display according to the fifth exemplary embodiment of the present invention.

FIG. 9 is a circuit diagram of a number of pixels of a display 200 in an organic EL display according to a fifth exemplary embodiment of the present invention, and FIG. 10 is a signal timing diagram of the organic EL display according to the fifth exemplary embodiment of the present invention. By way of example, the display 200 can be used in the organic EL display of FIG. 1 instead of the display 100 to realize an organic EL display according to the fifth exemplary embodiment. The display 200 has a pattern in which nine pixel circuits formed by three rows and three columns are repeated. FIG. 9 illustrates only a portion of the display 200, in which nine pixel circuits are formed at regions defined by first to third rows S1 to S3 and first to third columns D1 to D3.

Referring to FIG. 9, in the three pixel circuits coupled to the scan line S1 on the first row, gates of a transistor M3*r* of the pixel circuit coupled to the data line D1, a transistor M3*g* of the pixel circuit coupled to the data line D2, and a transistor M3*b* of the pixel circuit coupled to the data line D3 are coupled to an emit signal line E1*r*. In a like manner, gates of a transistor M3*g* of the pixel circuit coupled to the data line D1, a transistor M3*b* of the pixel circuit coupled to the data line D2, and a transistor M3*r* of the pixel circuit coupled to the data line D3 are coupled to an emit signal line E1*g*. Also, gates of a transistor M3*b* of the pixel circuit coupled to the data line D1, a transistor M3*r* of the pixel circuit coupled to the data line D2, and a transistor M3*g* of the pixel circuit coupled to the data line D3 are coupled to an emit signal line E1*b*.

In the three pixel circuits coupled to the scan line S2 on the second row, gates of a transistor M3*g* of the pixel circuit coupled to the data line D1, a transistor M3*b* of the pixel circuit coupled to the data line D2, and a transistor M3*r* of the pixel circuit coupled to the data line D3 are coupled to an emit signal line E2*r*. In a like manner, gates of a transistor M3*b* of the pixel circuit coupled to the data line D1, a transistor M3*r* of the pixel circuit coupled to the data line D2, and a transistor M3*g* of the pixel circuit coupled to the data line D3 are coupled to an emit signal line E2*g*. Also, gates of a transistor M3*r* of the pixel circuit coupled to the data line D1, a transistor M3*g* of the pixel circuit coupled to the data line D2, and a transistor M3*b* of the pixel circuit coupled to the data line D3 are coupled to an emit signal line E2*b*.

In the three pixel circuits coupled to the scan line S3 on the third row, gates of a transistor M3*b* of the pixel circuit coupled to the data line D1, a transistor M3*r* of the pixel circuit coupled to the data line D2, and a transistor M3*g* of the pixel circuit coupled to the data line D3 are coupled to an emit signal line E3*r*. In a like manner, gates of a transistor M3*r* of the pixel circuit coupled to the data line D1, a transistor M3*g* of the pixel circuit coupled to the data line D2, and a transistor M3*b* of the pixel circuit coupled to the data line D3 are coupled to an emit signal line E3*g*. Also, gates of a transistor M3*g* of the pixel circuit coupled to the data line D1, a transistor M3*b* of the pixel circuit coupled to the data line D2, and a transistor M3*r* of the pixel circuit coupled to the data line D3 are coupled to an emit signal line E3*b*.

Accordingly, a pixel circuit coupled to a scan line S(3*i*−2) of the (3*i*−2)th row (where 'i' is an integer less than 'n/3' when assuming that 'n' is a multiple of 3) and a (3*j*−2)th data line D(3*j*−2) (where 'j' is an integer less than 'm/3' when assuming that 'm' is a multiple of 3) has the same coupling relation as that of a pixel circuit coupled to the scan line S1 and the data line D1, a pixel circuit coupled to the scan line S(3*i*−2) and a (3*j*−1)th data line D(3*j*−1) has the same coupling relation as that of a pixel circuit coupled to the scan line S1 and the data line D2, and a pixel circuit coupled to the scan line S(3*i*−2) and a (3*j*)th data line D(3*j*) has the same coupling relation as that of a pixel circuit coupled to the scan line S1 and the data line D3. Also, a pixel circuit coupled to the scan line S(3*i*−1) of the (3*i*−1)th row and the data line D(3*j*−2) has the same coupling relation as that of a pixel circuit coupled to the scan line S2 and the data line D1, a pixel circuit coupled to the scan line S(3*i*−1) and the data line D(3*j*−1) has the same coupling relation as that of a pixel circuit coupled to the scan line S2 and the data line D2, and a pixel circuit coupled to the scan line S(3*i*−1) and the data line D(3*j*) has the same coupling relation as that of a pixel circuit coupled to the scan line S2 and the data line D3. In a like manner, a pixel circuit coupled to the scan line S(3*i*) of the (3*i*)th row and the data line D(3*j*−2) has the same coupling relation as that of a pixel circuit coupled to the scan line S3 and the data line D1, a pixel circuit coupled to the scan line S(3*i*) and the data line D(3*j*−1) has the same coupling relation as that of a pixel circuit coupled to the scan line S3 and the data line D2, and a pixel circuit coupled to the scan line S(3*i*) and the data line D(3*j*) has the same coupling relation as that of a pixel circuit coupled to the scan line S3 and the data line D3.

Referring to FIG. 10, in a subfield 1SF, when a select signal is applied to the scan line S1 of the first row, data voltages of R, G, and B corresponding to the red, green, and blue organic EL elements OLEDr, OLEDg, and OLEDb are respectively applied to the (3*j*−2)th data lines D1, D4, . . . , Dm−2, the (3*j*−1)th data lines D2, D5, Dm−1, and the (3*j*)th data lines D3, D6, . . . , Dm, and an emit signal is applied to the emit signal line E1*r* so that the red, green, and blue organic EL elements OLEDr, OLEDg, and OLEDb emit light in the three pixel circuits which are adjacent in the row direction.

When a select signal is applied to the scan line S2 of the second row, data voltages of G, B, and R corresponding to the green, blue, and red organic EL elements OLEDg, OLEDb, and OLEDr are respectively applied to the (3*j*−2)th data lines D1, D4, . . . , Dm−2, the (3*j*−1)th data lines D2, D5, . . . , Dm−1, and the (3*j*)th data lines D3, D6, . . . , Dm, and an emit signal is applied to the emit signal line E2*r* so that the green, blue, and red organic EL elements OLEDg, OLEDb, and OLEDr emit light in the three pixel circuits which are adjacent in the row direction.

When a select signal is applied to the scan line S3 of the third row, data voltages of B, R, and G corresponding to the blue, red, and green organic EL elements OLEDb, OLEDr, and OLEDg are respectively applied to the (3*j*−2)th data lines D1, D4, . . . , Dm−2, the (3*j*−1)th data lines D2, D5, . . . , Dm−1, and the (3*j*)th data lines D3, D6, . . . , Dm, and an emit signal is applied to the emit signal line E3*r* so that the blue, red, and green organic EL elements OLEDb, OLEDr, and OLEDg emit light in the three pixel circuits which are adjacent in the row direction.

In a like manner, in the subfield 1SF, when a select signal is applied to the (3*i*−2)th scan lines S1, S4, . . . , Sn−2, data voltages of R, G, and B corresponding to the red, green, and blue organic EL elements OLEDr, OLEDg, and OLEDb are respectively applied to the (3*j*−2)th data lines D1, D4, . . . , Dm−2, the (3*j*−1)th data lines D2, D5, . . . , Dm−1, and the (3*j*)th data lines D3, D6, . . . , Dm so that the red, green, and blue organic EL elements OLEDr, OLEDg, and OLEDb emit light in the three pixel circuits which are adjacent in the row direction. When a select signal is applied to the (3*i*−1)th scan lines S2, S5, . . . , Sn−1, data voltages of G, B, and R corresponding to the green, blue, and red organic EL elements OLEDg, OLEDb, and OLEDr are respectively applied to the (3*j*−2)th data lines D1, D4, . . . , Dm−2, the (3*j*−1)th data lines D2, D5, . . . , Dm−1, and the (3*j*)th data lines D3, D6, . . . , Dm so that the green, blue, and red organic EL elements OLEDg, OLEDb, and OLEDr emit light in the three pixel circuits which are adjacent in the row direction. Also, when a select signal is applied to the (3*i*)th scan lines S3, S6, . . . , Sn, data voltages of B, R, and G corresponding to the blue, red, and green organic EL elements OLEDb, OLEDr, and OLEDg are respectively applied to the (3*j*−2)th data lines D1, D4, . . . , Dm−2, the (3*j*−1)th data lines D2, D5, . . . , Dm−1, and the (3*j*)th data lines D3, D6, . . . , Dm so that the blue, red, and green organic EL elements OLEDb, OLEDr, and OLEDg emit light in the three pixel circuits which are adjacent in the row direction.

In a subsequent subfield 2SF, when a select signal is applied to the scan line S1, data voltages of G, B, and R corresponding to the green, blue, and red organic EL elements OLEDg, OLEDb, and OLEDr are respectively applied to the data lines D1, D4, . . . , Dm−2, the data lines D2, D5, . . . , Dm−1, and the data lines D3, D6, . . . , Dm, and an emit signal is applied to the emit signal line E1*g* so that the green, blue, and red organic EL elements OLEDg, OLEDb, and OLEDr emit light in the three pixel circuits which are adjacent in the row direction.

When a select signal is applied to the scan line S2, data voltages of B, R, and G, corresponding to the blue, red, and green organic EL elements OLEDb, OLEDr, and OLEDg are respectively applied to the data lines D1, D4, . . . , Dm−2, the data lines D2, D5, . . . , Dm−1, and the data lines D3, D6, . . . , Dm, and an emit signal is applied to the emit signal line E2*g* so that the blue, red, and green organic EL elements OLEDb, OLEDr, and OLEDg emit light in the three pixel circuits which are adjacent in the row direction.

When a select signal is applied to the scan line S3, data voltages of R, G, and B corresponding to the red, green, and blue organic EL elements OLEDr, OLEDg, and OLEDb are respectively applied to the data lines D1, D4, . . . , Dm−2, the data lines D2, D5, . . . , Dm−1, and the data lines D3, D6, . . . , Dm, and an emit signal is applied to the emit signal line E3*g* so that the red, green, and blue organic EL elements OLEDr, OLEDg, and OLEDb emit light in the three pixel circuits which are adjacent in the row direction.

In a like manner, in the subfield 2SF, when a select signal is applied to the (3*i*−2)th scan lines S1, S4, . . . , Sn−2, data voltages of G, B, and R corresponding to the green, blue, and red organic EL elements OLEDg, OLEDb, and OLEDr are respectively applied to the (3*j*−2)th data lines D1, D4, . . . , Dm−2, the (3*j*−1)th data lines D2, D5, . . . , Dm−1, and the (3*j*)th data lines D3, D6, . . . , Dm so that the green, blue, and red organic EL elements OLEDg, OLEDb, and OLEDr emit light in the three pixel circuits which are adjacent in the row direction. When a select signal is applied to the (3*i*−1)th scan lines S2, S5, . . . , Sn−1, data voltages of B, R, and G corresponding to the blue, red, and green organic EL elements OLEDb, OLEDr, and OLEDg are respectively applied to the (3*j*−2)th data lines D1, D4, . . . , Dm−2, the (3*j*−1)th data lines D2, D5, . . . , Dm−1, and the (3*j*)th data lines D3, D6, . . . , Dm so that the blue, red, and green organic EL elements OLEDb, OLEDr, and OLEDg emit light in the three pixel circuits which are adjacent in the row direction. Also, when a select signal is applied to the (3*i*)th scan lines S3, S6, . . . , Sn, data voltages of R, G, and B corresponding to the red, green, and blue organic EL elements OLEDr, OLEDg, and OLEDb are respectively applied to the (3*j*−2)th data lines D1, D4, . . . , Dm−2, the (3*j*−1)th data lines D2, D5, . . . , Dm−1, and the (3*j*)th data lines D3, D6, . . . , Dm so that the red, green, and blue organic EL elements OLEDr, OLEDg, and OLEDb emit light in the three pixel circuits which are adjacent in the row direction.

In a subsequent subfield 3SF, when a select signal is applied to the scan line S1, data voltages of B, R, and G corresponding to the blue, red, and green organic EL elements OLEDb, OLEDr, and OLEDg are respectively applied to the (3*j*−2)th data lines D1, D4, . . . , Dm−2, the (3*j*−1)th data lines D2, D5, . . . , Dm−1, and the (3*j*)th data lines D3, D6, . . . , Dm, and an emit signal is applied to the emit signal line E1*b* so that the blue, red, and green organic EL elements OLEDb, OLEDr, and OLEDg emit light in the three pixel circuits which are adjacent in the row direction.

When a select signal is applied to the scan line S2, data voltages of R, G, and B corresponding to the red, green, and blue organic EL elements OLEDr, OLEDg, and OLEDb are respectively applied to the (3*j*−2)th data lines D1, D4, . . . , Dm−2, the (3*j*−1)th data lines D2, D5, . . . , Dm−1, and the (3*j*)th data lines D3, D6, . . . , Dm, and an emit signal is applied to the emit signal line E2*b* so that the red, green, and blue organic EL elements OLEDr, OLEDg, and OLEDb emit light in the three pixel circuits which are adjacent in the row direction.

When a select signal is applied to the scan line S3, data voltages of G, B, and R corresponding to the green, blue, and red organic EL elements OLEDg, OLEDb, and OLEDr are respectively applied to the (3*j*−2)th data lines D1, D4, . . . , Dm−2, the (3*j*−1)th data lines D2, D5, . . . , Dm−1, and the (3*j*)th data lines D3, D6, . . . , Dm, and an emit signal is applied to the emit signal line E3*g* so that the green, blue, and red organic EL elements OLEDg, OLEDb, and OLEDr emit light in the three pixel circuits which are adjacent in the row direction.

In a like manner, in the subfield 3SF, when a select signal is applied to the (3*i*−2)th scan lines S1, S4, . . . , Sn−2, data voltages of B, R, and G corresponding to the blue, red, and green organic EL elements OLEDb, OLEDr, and OLEDg are respectively applied to the (3*j*−2)th data lines D1, D4, . . . , Dm−2, the (3*j*−1)th data lines D2, D5, . . . , Dm−1, and the (3*j*)th data lines D3, D6, . . . , Dm so that the blue, red, and green organic EL elements OLEDb, OLEDr, and OLEDg emit light in the three pixel circuits which are adjacent in the row direction. When a select signal is applied to the (3*i*−1)th scan lines S2, S5, . . . , Sn−1, data voltages of R, G, and B corresponding to the red, green, and blue organic EL elements OLEDr, OLEDg, and OLEDb are respectively applied to the (3*j*−2)th data lines D1, D4, . . . , Dm−2, the (3*j*−1)th data lines D2, D5, . . . , Dm−1, and the (3*j*)th data lines D3, D6, . . . , Dm so that the red, green, and blue organic EL elements OLEDr, OLEDg, and OLEDb emit light in the three pixel circuits which are adjacent in the row direction. Also, when a select signal is applied to the (3*i*)th scan lines S3, S6, . . . , Sn, data voltages of G, B, and R corresponding to the green, blue, and red organic EL elements OLEDg, OLEDb, and OLEDr are respectively applied to the (3*j*−2)th data lines D1, D4, . . . , Dm−2, the (3*j*−1)th data lines D2, D5, . . . , Dm−1, and the (3*j*)th data lines D3, D6, . . . , Dm so that the green, blue, and red organic EL elements OLEDg, OLEDb, and OLEDr emit light in the three pixel circuits which are adjacent in the row direction.

Therefore, three colors are mixed and emitted in the pixel circuits provided on the same row in one subfield, and three colors are mixed and emitted in the pixel circuits provided on the same column. That is, a plurality of pixel circuits which respectively emit red, green, and blue light on the total screen are provided in one subfield, and one pixel circuit emits different colors for each subfield so that the red, green, and blue are emitted in one field. As a result, since the three colors are mixed and emitted in the row direction and the column direction, the color separation phenomenon which may be caused because of different colors on the upper region and lower region of the screen is reduced or eliminated.

While each row has a different color emitted in the fifth exemplary embodiment, without being restricted to this, it is possible to combine a plurality of rows into a group, and control each group to emit a different color. Also, while the emit elements of three colors have been described in the exemplary embodiments, the principles of the present invention are applicable to and the scope of the present invention includes pixel circuits having emit elements of two or more than three colors. These additional embodiments will not be described since those skilled in the art would understand them from the above-noted descriptions.

Further, while the colors are mixed and emitted in the row direction and the column direction in the fifth exemplary embodiment, it is also possible to emit light with the same color in the column direction and emit light with mixed colors in the row direction.

According to the exemplary embodiments of the present invention, the configuration of elements used within the pixels and the wiring design for transmitting the current, voltages, and signals are simplified since the emit elements of various colors on one pixel can be driven by common driving and switching transistors and capacitors, thereby improving the aperture ratio in the pixel. Further, the color separation phenomenon is reduced or eliminated by emitting different colors for the respective rows in one subfield.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a plurality of pixels arranged in rows and columns for displaying an image during a field having a plurality of subfields, each of the pixels comprising a plurality of light emitting elements having different colors, wherein each of the plurality of light emitting elements is adapted to emit light in response to an applied current;

a plurality of select lines coupled to the pixels for applying a plurality of select signals, each of the select lines being coupled to a corresponding one of the rows of pixels to apply a corresponding one of the select signals thereto;

a plurality of data lines for applying data signals to the pixels;

a plurality of emit lines coupled to the pixels for applying a plurality of emit signals to the pixels, wherein each of the rows of pixels is coupled to a corresponding group of emit lines among the plurality of emit lines;

a scan driver configured to provide the plurality of select signals sequentially on all of the select lines to sequentially select all of the rows of pixels during each of the plurality of subfields; and an emit driver configured to apply the emit signals to the pixels for the pixels to start emitting different color lights in a same one of the rows for each of the subfields, wherein the emit driver is configured to apply the emit signals to fewer than all of the emit lines in the group of emit lines corresponding to each row of the pixels in each of the subfields, and wherein each emit line of the group of emit lines corresponding to each row of pixels is configured to selectively control the emitting of at least two of the different color lights in the corresponding row of pixels, wherein each of the pixels further comprises a capacitor for storing a voltage corresponding to one of the data signals applied in response to the corresponding one of the select signals, and a driving transistor coupled to the plurality of light emitting elements for outputting the applied current corresponding to the voltage stored in the capacitor to the plurality of light emitting elements, and wherein, in one of the subfields, at least one of the pixels starts emitting light having a color which is different from a color of a light it starts emitting in another one of the subfields.

2. The display device of claim 1, wherein each of the light emitting elements emits red, green or blue light, and wherein the pixels on the same one of the rows concurrently start emitting the red, green and blue lights in each of the plurality of subfields.

3. The display device of claim 2, wherein the pixels on the same one of the columns sequentially start emitting the red, green and blue lights in each of the plurality of subfields.

4. The display device of claim 1, wherein white balance of the image is controlled by making emit periods of the light emitting elements having different colors to be different.

5. The display device of claim 1, wherein a number of the emit lines coupled to each of the rows of pixels is the same as a number of the light emitting elements in each of the pixels.

6. The display device of claim 1, wherein a number of the emit lines coupled to each of the rows of pixels is less than a number of the light emitting elements in each of the pixels by at least one.

7. A display device including a plurality of scan lines including a first scan line and a second scan line for applying select signals, a plurality of emit lines including a first group of emit lines and a second group of emit lines for applying emit signals, a plurality of data lines including a first data line and a second data line for applying data signals for displaying an image during a field having a plurality of subfields, a plurality of pixel circuits coupled to the scan lines and the data lines, an emit driver configured to apply the emit signals to fewer than all of the emit lines in each of the first and second groups of emit lines in each of the subfields, and a scan driver configured to sequentially provide the select signals on all of the scan lines to apply the data signals to each of the pixel circuits at least once for each of the subfields, wherein each of the pixel circuits comprises:

at least two emit elements for emitting light having different colors, wherein each of the emit elements emits light responsive to an applied current;

a capacitor for storing a voltage corresponding to one of the data signals applied in response to one of the select signals; and a driving transistor coupled to the at least two emit elements for outputting the applied current corresponding to the voltage stored in the capacitor to the at least two emit elements, and wherein, in a first one of the subfields, one of the emit elements of a first color starts emitting light in a first pixel circuit of the pixel circuits, which is coupled to the first scan line, a one of the first group of emit lines and the first data line, one of the emit elements of a color which is different from the first color starts emitting light in a second pixel circuit of the pixel circuits, which is coupled to the first scan line, the one of the first group of emit lines and the second data line, one of the emit elements of a second color starts emitting light in a third pixel circuit of the pixel circuits, which is coupled to the second scan line, a one of the second group of emit lines and the first data line, and one of the emit elements of a color which is different from the second color starts emitting light in a fourth pixel circuit of the pixel circuits, which is coupled to the second scan line, the one of the second group of emit lines and the second data line.

8. The display device of claim 7, wherein each of the pixel circuits further comprises a switching transistor for applying one of the data signals provided by one of the data lines to the capacitor in response to one of the select signals provided by one of the scan lines.

9. The display device of claim 8, wherein each of the pixel circuits further comprises at least two emitting transistors coupled between the driving transistor and the emit elements, and one of the emit elements emits light in response to an operation of the emitting transistors.

10. The display device of claim 9, wherein the emit signal lines are respectively coupled to gates of the emitting transistors and apply control signals for controlling the operation of the emitting transistors, wherein one of the emitting transistors is turned on by one of the control signals applied through the emit signal lines and the applied current is applied to one of the emit elements from the driving transistor.

11. The display device of claim 7, wherein, in a second one of the subfields, one of the emit elements of a third color which is different from the first color starts emitting light in the first pixel circuit, one of the emit elements of a color which is different from the third color starts emitting light in the second pixel circuit, one of the emit elements of another color which is different from the third color starts emitting light in the third pixel circuit, and one of the emit elements of a color which is different from said another color starts emitting light in the fourth pixel circuit.

12. The display device of claim 7, wherein the emit elements emit light at least once during the field.

13. The display device of claim 8, wherein the emit elements comprise an emit element of the first color, an emit element of the second color, and an emit element of a third color, and wherein at least one of the pixel circuits further comprises a first emitting transistor coupled between the driving transistor and the emit element of the first color, a second emitting transistor coupled between the driving transistor and the emit element of the second color, and a third emitting transistor coupled between the driving transistor and the emit element of the third color.

14. The display device of claim 13, wherein, in a second one of the subfields, the emit element of the second color starts emitting light in the first pixel circuit, and one of the emit elements of a color which is different from the second color starts emitting light in the second pixel circuit, and wherein, in a third one of the subfields, the emit element of the third color starts emitting light in the first pixel circuit, and one of the emit elements of a color which is different from the third color starts emitting light in the second pixel circuit.

15. The display device of claim 14, wherein the emit element of the third color starts emitting light in the third pixel circuit in the second one of the subfields, and wherein the emit element of the first color starts emitting light in the third pixel circuit in the third one of the subfields.

16. The display device of claim 14, wherein one of the emit elements of a color which is different from colors of the emit elements which start emitting light in the first and second pixel circuits starts emitting light in a fifth pixel circuit of the pixel circuits, which is coupled to the first scan line and a third data line in the first, second and third ones of the subfields.

17. The display device of claim 16, wherein one of the emit elements of a color which is different from colors of the emit elements which start emitting light in the first and third pixel circuits starts emitting light in a sixth pixel circuit of the pixel circuits, which is coupled to a third scan line and the first data line in the first, second and third ones of the subfields.

18. The display device of claim 13, wherein the emit element of the first color, the emit element of the second color and the emit element of the third color emit light at least once during the field.

19. A display device including a plurality of scan lines for applying select signals, a plurality of groups of emit lines for applying emit signals, a plurality of data lines for applying data signals for displaying an image during a field having a plurality of subfields, a plurality of pixel circuits, each coupled to one of the scan lines, one of the groups of emit lines and one of the data lines, a scan driver configured to provide the select signals sequentially on all of the plurality of scan lines to apply a corresponding one of the data signals to each of the pixel circuits at least once for each of the subfields, and an emit driver configured to provide the emit signals to fewer than all of the emit lines in each group of emit lines in each of the subfields, wherein each of the pixel circuits comprises:

at least two emit elements for emitting light having different colors, wherein each of the emit elements emits light responsive to an applied current;

a switching transistor for applying one of the data signals corresponding to one of the emit elements in response to one of the select signals;

a capacitor for storing a voltage corresponding to the one of the data signals applied by the switching transistor;

a driving transistor coupled to the at least two emit elements for outputting the applied current corresponding to the voltage stored in the capacitor to the at least two emit elements;

a switch for selectively outputting the applied current provided by the driving transistor to one of the emit elements of a color which corresponds to the one of the data signals in response to one of the emit signals; and a data driver configured to apply, in a first one of the subfields, one of the data signals corresponding to one of the emit elements of a first color to a data line of a first group including at least one of the data lines, and to apply, in said first one of the subfields, one of the data signals corresponding to one of the emit elements of a second color, which is different from the first color, to a data line of a second group including at least one of the data lines, when one of the select signals is applied to a scan line coupled to the one of the emit elements of the first color and the one of the emit elements of the second color, wherein an emit signal of the emit signals is provided through a same emit line of the group of emit lines corresponding to the respective pixel circuits comprising the one of the emit elements of the first color and the one of the emit elements of the second color, to control light emission of the one of the emit elements of the first color and the one of the emit elements of the second color.

20. The display device of claim 19, wherein, in the first one of the subfields, one of the data signals corresponding to one of the emit elements of a third color is applied to a data line of a third group including at least one of the data lines when one of the select signals is applied to the scan line of the first group including at least one of the scan lines.

21. The display device of claim 19, wherein, in the first one of the subfields, one of the data signals corresponding to one of the emit elements of a color which is different from the first color is applied to the data line of the first group including at least one of the data lines, and one of the data signals corresponding to one of the emit elements of a color which is different from the second color is applied to the data line of the second group including at least one of the data lines, when one of the select signals is applied to a scan line of a second group including at least one of the scan lines.

22. The display device of claim 19, wherein, in a second one of the subfields, one of the data signals corresponding to one of the emit elements of a color which is different from the first color is applied to the data line of the first group including at least one of the data lines, and one of the data signals corresponding to one of the emit elements of a color which is different from the second color is applied to the data line of the second group including at least one of the data lines, when one of the select signals is applied to the scan line of the first group including at least one of the scan lines.

23. The display device of claim 22, wherein the emit elements emit light at least once during the field.

24. A method of driving a display device including a plurality of pixel circuits arranged in rows and columns, wherein each of the pixel circuits comprises at least two emit elements for emitting light of different colors responsive to an applied current, a capacitor for storing a voltage corresponding to a data signal, and a transistor coupled to the at least two emit elements for supplying the applied current corresponding to the voltage stored in the capacitor to the at least two emit elements through corresponding switches for the at least two emit elements, the method of driving during a field having a plurality of subfields comprising:

start emitting, in a first one of the subfields, one of the emit elements of a first color in a first pixel circuit on a row of a first row group including at least one of the rows and a column of a first column group including at least one of the columns;

start emitting, in the first one of the subfields, one of the emit elements of a second color which is different from the first color in a second pixel circuit on the row of the first row group and a column of a second column group including at least one of the columns;

start emitting, in a second one of the subfields, the emit elements of colors in the first and second pixels circuits, respectively, which are different from the first and second colors, respectively, wherein each of the rows of the pixel circuits is selected for emission of at least one of the emit elements thereon by sequentially selecting all of select lines coupled to the rows of the pixel circuits and applying emit signals to groups of emit lines, each coupled to one of the rows of the pixel circuits, during each of the plurality of subfields, and wherein, during each of the plurality of subfields, the emit signals are applied to fewer than all of the emit lines in each of the groups of emit lines, and wherein each emit line of each of the groups of emit lines selectively controls the emitting of emit elements of at least two different colors on a same one of the rows of the pixel circuits.

25. The method of claim 24, comprising:

start emitting, in the first one of the subfields, one of the emit elements of a third color which is different from the first color in a third pixel circuit provided on a row of a second row group including at least one of the rows and a column of the first group; and start emitting, in the second one of the subfields, one of the emit elements of a color which is different from the third color in the third pixel circuit.

26. The method of claim 24, wherein the emit elements emit light at least once during the field.

* * * * *

UNITED STATES PATENT AND TRADEMARK OFFICE

CERTIFICATE OF CORRECTION

PATENT NO. : 7,768,482 B2
APPLICATION NO. : 11/055441
DATED : August 3, 2010
INVENTOR(S) : Won-Kyu Kwak It is certified that error appears in the above-identified patent and that said Letters Patent is hereby corrected as shown below:

In the Claims

| | |
|---|---|
| Column 16, Claim 7, line 46 | Delete "line,"<br>Insert -- line; -- |
| Column 16, Claim 7, line 50 | Delete "line,"<br>Insert -- line; -- |
| Column 16, Claim 7, line 54 | Delete "line,"<br>Insert -- line; -- |

Signed and Sealed this
Tenth Day of April, 2012

David J. Kappos

David J. Kappos
*Director of the United States Patent and Trademark Office*